United States Patent [19]

Windley

[11] 4,295,329

[45] Oct. 20, 1981

[54] COBULKED CONTINUOUS FILAMENT HEATHER YARN METHOD AND PRODUCT

[75] Inventor: William T. Windley, Seaford, Del.

[73] Assignee: E. I. Du Pont de Nemours and Company, Wilmington, Del.

[21] Appl. No.: 158,120

[22] Filed: Jun. 10, 1980

[51] Int. Cl.[3] ..... D02G 1/16; D02G 1/18; D02G 3/24

[52] U.S. Cl. ..... 57/245; 28/271; 57/205; 57/246; 57/350

[58] Field of Search ..... 57/205, 239, 244–247, 57/350, 351, 908; 28/254, 257, 271–273

[56] References Cited

U.S. PATENT DOCUMENTS

| | | | |
|---|---|---|---|
| 3,534,540 | 10/1970 | Collingwood et al. | 57/908 X |
| 3,811,263 | 5/1974 | Newton | 57/246 |
| 3,854,177 | 12/1974 | Breen et al. | 57/350 |
| 3,971,202 | 7/1976 | Windley | 57/245 X |
| 4,059,873 | 11/1977 | Nelson | 28/271 |

*Primary Examiner*—John Petrakes

[57] ABSTRACT

An improved method for making a continuous filament heather dyeable yarn involves cobulking in a hot fluid jet process a first unbulked yarn with a second differentially dyeable previously bulked yarn. The method enhances differential dyeability in the product when both yarns have a common type of chemical dye site and the second yarn has a greater concentration of those dye sites than the first yarn.

23 Claims, 2 Drawing Figures

COBULKED CONTINUOUS FILAMENT HEATHER YARN METHOD AND PRODUCT

DESCRIPTION

1. Technical Field

This invention concerns an improved method for making continuous filament heather dyeable yarns by cobulking two or more differentially dyeable yarns and improved cobulked heather yarns having enhanced differential dyeability.

2. Background Art

Yarns having the appearance provided by many flecks of various colors randomly distributed throughout the yarn are commonly called heather yarns. Heather yarns have long been obtained from random mixtures of differently colored natural staple fibers such as wool by controlling the degree of mixing of the fibers during preparation of the staple yarn. Many methods are now also known in the art for producing heather colored or heather colorable yarns of bulked synthetic continuouts filaments by various sequences and combinations of conventional yarn bulking, entangling or intermingling treatments with and without some twisting in the components or in the combined yarn. These methods can be used to obtain a wide variety of products having degrees of heather from very bold, with limited filament intermingling, to very soft or fine, with a high degree of filament intermingling between the components.

For instance, U.S. Pat. No. 3,811,263 (Newton), reissued as No. Re. 29,352, concerns a method for producing a heather yarn in which major yarn bundles are separately drawn and then combined into a composite yarn by cobulking followed by impacting the yarn with gas streams from a plurality of jets to randomly entangle portions of the filaments within the yarn. U.S. Pat. No. 3,534,540 (Collingwood et al.) concerns a process for providing a heather dyeable yarn which comprises simultaneously crimping synthetic filaments of at least two differentially dyeable types of nylon followed by entangling of the crimped filaments and then optionally twisting the yarn. U.S. Pat. No. 4,059,873 (Nelson) discloses a process for making a continuous filament heather dyed or dyeable yarn from yarns of crimped continuous filaments of different color or different dye receptivity by tensioning the yarns to straighten crimp and to disentangle the filaments followed by feeding the yarns together into a jet intermingling zone from which the resulting yarn is withdrawn at a rate less than the feed rate of the component yarns to the zone. U.S. Pat. No. 3,854,177 (Breen et al.) concerns a process for texturing yarns of thermoplastic synthetic continuous filaments with a hot compressible fluid and receiving the treated filaments on a moving surface to remove the filaments from the fluid in a substantially tensionless state. The patent discloses that by using a multiple feed of different fiber types, a blend of the fibers in the treated yarn is obtained. A number of feed yarn ends can be used and the resulting yarn may have the ends well blended or separable. Cobulking of filaments of nylon with polypropylene and of nylon with acetate are exemplified.

U.S. Pat. No. 3,971,202 (Windley) does not disclose heather yarns but does concern a method for producing a cobulked continuous filament yarn containing filaments of first and second yarns with the filaments of the second yarn, such as an antistatic component, being frequently located near the surface of the cobulked yarn. That the second yarn may impart some aesthetic quality such as an unusual dye characteristic is disclosed. The method involves drawing the first yarn and feeding it along with a second yarn having a lower shrinkage potential into a hot gas bulking jet to randomly crimp and entangle the filaments of both yarns, thus forming a cobulked yarn in which the filaments of the second yarn are 4 to 20% longer than the filaments of the first yarn.

The present invention relates to improvements in the method and product of the Windley patent adapted to heather yarns.

Bulked continuous filament (hereafter BCF) heather yarns have become quite popular in new styles for carpets. In order to meet the demands of the trade it has become increasingly advantageous to be able to provide a variety of heather effects and BCF yarn counts to the trade. Such product variety calls for a versatile process capable of producing a broad range of heather products and yet capable of competing economically with the many established products and processes known in the art.

For reasons of economy and efficiency BCF carpet yarns are commonly produced by a coupled spin-draw-bulk process as represented and disclosed for example, with respect to FIG. 3 in above Breen et al. U.S. Pat. No. 3,854,177. Differently dyeable polymers for BCF heather yarns are commonly spun from separate spinning positions. It is quite expensive to modify a spinning position to co-spin two different polymers; once a position is so modified it becomes less economical to produce a single component yarn therefrom, thus limiting its use. Whereas methods for producing heather yarns which combine previously spun and drawn yarns in a subsequent separate operation are quite versatile with respect to the types of yarns which can be combined, tend to be limited to slower yarn speeds and they require separate facilities and space for the combining operation. Consequently one object of the present invention is an improved method for producing a cobulked heather dyeable yarn on conventional yarn drawing and bulking equipment, and particularly such a method operable at yarn speeds of greater than 1000 meters per minute.

Another object of this invention is a nondirectional heather dyeable BCF yarn having enhanced differential dyeability. Other objects are apparent from the following description of the invention.

DETAILED DESCRIPTION OF THE DRAWINGS

Figure 1:
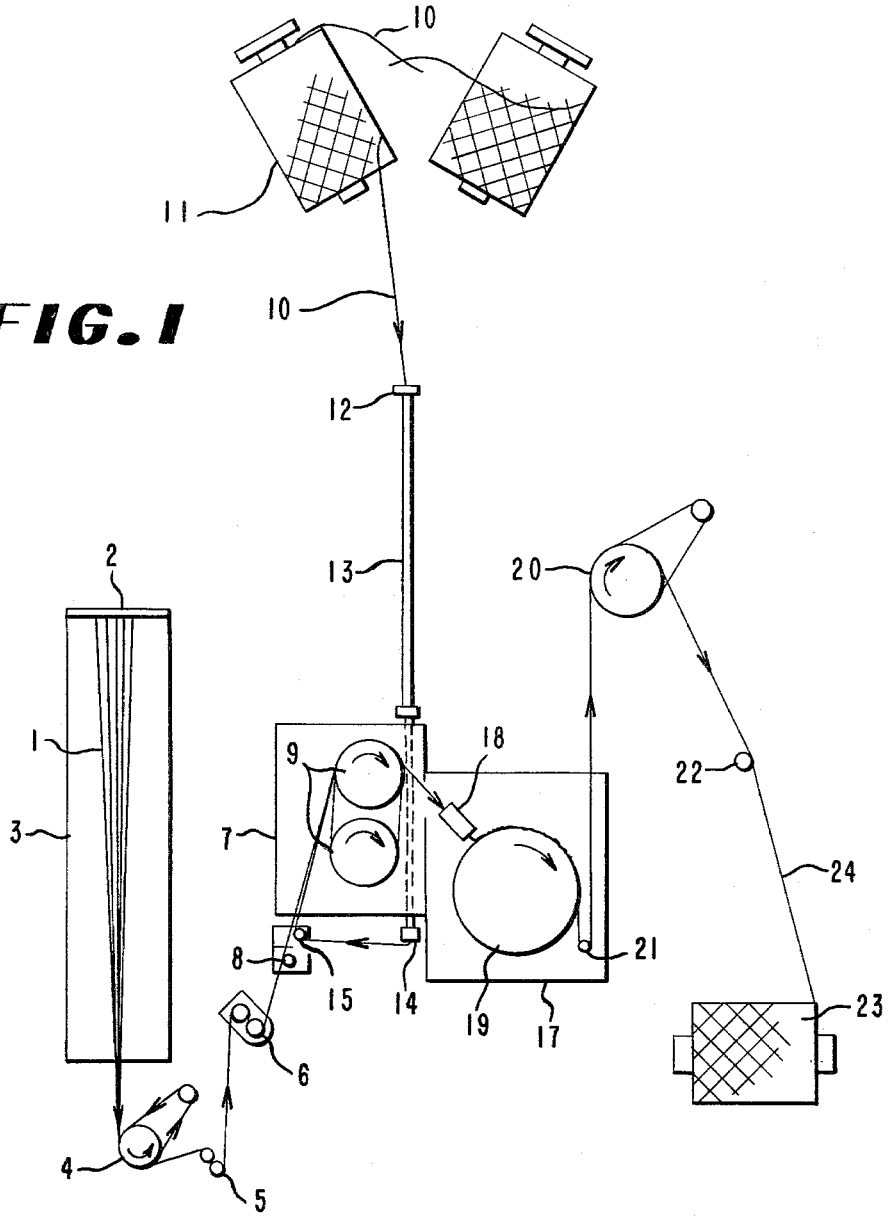
FIG. 1 is a schematic representation of a preferred embodiment of the method of the invention.

FIG. 1 represents a first yarn 1 being extruded at spinneret 2 with quenching by cross flow air at chimney 3. Feed roll 4, and its associated idler roll, at the base of the chimney controls yarn spinning speed and spun yarn denier. The yarn is then drawn across two sets of draw pins 5 and 6 and guided into an enclosure, or insulated chest, 7 by entrance guide 8. A pair of skewed draw rolls 9 in the enclosure are internally heated and have a surface speed greater than that of feed roll 4 to impose the desired draw ratio on the yarn 1.

A second yarn 10 having filaments which are differentially dyeable with respect to those of the first yarn and which has been bulked with a hot turbulent fluid prior to being wound on supply package 11 is delivered from over the end of package 11 held on a creel (not shown) and passes through guide 12 and transport tube 13. A ceramic guide 14 is provided on the lower end of the tube to reduce wear and minimize tension buildup. Guide 15 is positioned to keep the first and second yarns separated in planes both parallel and perpendicular, to the plane of the drawing, as they approach rolls 9. The two yarns remain separate from one another and both yarns are wrapped 9½ times on the pair of rolls 9. The yarns then pass together from enclosure 7 into chamber 17.

In chamber 17, bulking jet 18 forwards the combined yarns simultaneously in a high velocity stream of hot turbulent fluid such as air or steam in a confined space to randomly crimp, shrink and randomly comingle the filaments and deposit them in a cobulked crimped condition under low tension on the screen surface of drum 19 moving at a much slower speed than that of the forwarded yarn. The filaments are cooled while on the screen, optionally with a liquid mist (not shown); then take up roll 20 pulls the cobulked yarn 24 off of drum 19 and around guide 21. The yarn then passes guide 22 to a windup (not shown) which applies sufficient tension to wind the yarn into a firm stable package 23.

Figure 2:
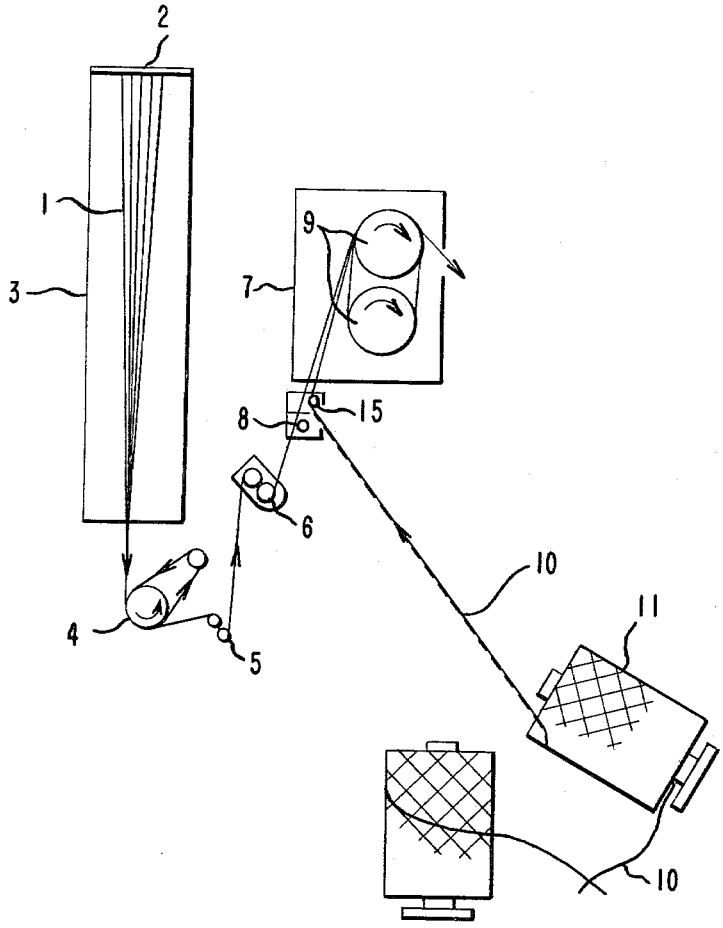
FIG. 2 is a partial copy of FIG. 1 but shows a different position for the source of the second yarn.

FIG. 2 shows FIG. 1 in part but with second yarn 10 coming from package 11 on a creel (not shown) which is at a level below rolls 9. Yarn 10 proceeds to guide 15 without any interfloor tube as in FIG. 1. The other components are the same as in FIG. 1.

DISCLOSURE OF THE INVENTION

This invention provides an improved composite cobulked continuous filament yarn containing a first oriented continuous multifilament yarn which has been bulked in a hot fluid jet process simultaneously with a second oriented continuous multifilament yarn, the filaments of both yarns being randomly intermingled throughout the length of the composite yarn and having random three-dimensional curvilinear filament crimp with frequently alternating regions of S and Z filament twist, the filaments of said second yarn being at least about 4% longer in said composite yarn than the filaments of said first yarn, wherein the improvement comprises: the filaments of said first and second yarns being of polymers containing the same type of chemical dye site with the filaments of said second yarn having a substantially greater concentration of said dye site in equivalents per unit weight of polymer than the filaments of said first yarn thus providing differential dyeability. Preferably, the filaments of said second yarn are from about 4% to about 20% longer than the filaments of said first yarn, and more preferably from about 4% to about 10% longer. This difference in filament length relates not only to a consequential degree of filament intermingling between the yarns but also to consequential differences in tensile properties between filaments of the two yarns; in addition to an enhancement in differential dyeing properties which can be realized by this invention.

The filaments of said first yarn comprise from about 25% to about 75% of the total weight (or denier) of said first and second yarns in order to provide the desired heather and multicolor effects upon differential dyeing. This proportion of yarns is also needed to realize the benefits of the first yarn becoming the load bearing component in the cobulking step which load bearing is believed to contribute to the enhanced differential dye effects and the resulting differential filament tensile and crimped properties in the cobulked product.

The enhancement in differential dyeing qualities of the invention is particularly effective when the polymers of said first and second yarns are polyamides, i.e., nylon, in which the chemical dye sites of interest are the polymer amine end groups. The enhancement occurs when the concentration of such dye sites in said first yarn is less than that in said second yarn; whereupon the invention provides a greater difference in dyeability or dye-stepping between the two yarns when dyed competitively than is provided by such yarns when bulked individually under comparable conditions. This enhancement is particularly significant when the first polyamide yarn contains cationically dyeable sulfonate dye sites and the second yarn is a polyamide of regular or deep acid-dyeing capability as determined by the concentration of amine ends with respect to the carboxyl end groups in the polymer as known in the art. The invention then results in less staining of the cationic dyed yarn by acid dyes, thus enhancing the differential dye effect between the cationically dyed filaments and the acid dyed filaments.

Apparently as a result of the differential change in filament lengths during the cobulking step, the load bearing filaments of the first yarn tend to have lower crimp and a greater tenacity, modulus and toughness than filaments of the second yarn in the final cobulked yarn. However, these differences do not interfere with overall desirable bulk, tensile properties and performance of the cobulked yarn.

This invention also provides a method of producing a composite cobulked continuous filament yarn containing filaments of a first oriented continuous filament yarn and of a second oriented continuous filament yarn in which the filaments of said second yarn are longer than the filaments of said first yarn said method including the steps of (1) feeding said first yarn in an undrawn state at a controlled speed to a pair of heated draw rolls, (2) wrapping said first yarn around said draw rolls a sufficient number of times to avoid slippage thereon and said rolls being driven at a surface speed at least twice the feeding speed of said first yarn thereby applying tension to and drawing to molecularly orient said first yarn, (3) also feeding to said pair of draw rolls from a yarn package at a tension of less than 1.0 grams per denier said second yarn having a lower shrinkage potential in a hot gas bulking jet than said first yarn, (4) wrapping said second yarn around said draw rolls to prevent slippage thereon, (5) bringing said first and second yarns together and forwarding the combined yarns in a high velocity stream of hot turbulant fluid in a confined space which randomly crimps and entangles the filaments thereof and thereby forms a composite cobulked yarn in which the filaments of said second yarn are at least 4% longer than the filaments of said first yarn, (6) removing the cobulked yarn from the stream of hot fluid and cooling it at low tension while the filaments are in a crimped condition to set crimp in the filaments and (7) winding the cobulked yarn into a package under tension, the improvement for making a heather dyeable yarn comprising: feeding to said draw rolls as said second yarn heat-relaxed yarn containing crimped filaments which filaments are differentially dyeable with respect to the filaments of said first yarn and which filaments constitute from about 25% to about 75% of the total weight of the cobulked yarn. It is preferred that the second yarn be fed from a package to the draw rolls at a tension that is less than about 0.5 grams/denier.

Little advantage is provided by having a differential change in length between the first and second yarns of greater than about 20%. Preferred results are realized when the differential change in length between the first and second yarns is within the range of from about 4% to about 10%.

The method is capable of being operated at high yarn speeds. Because of the advantages in productivity it is particularly useful when operated at 1,000 meters/minute and above. Such high speed is also suitable for coupling the method with a spinning process such that the first yarn is fed from a spinning zone directly to the draw zone of this invention.

The term "heather dyeable" as used herein refers to a yarn which under cross-dyeing conditions (commonly used in the trade to obtain multiple colors from a single dye bath) becomes differently colored in a random manner to give numerous flecks and spots of specific colors dispersed among blended regions of those colors along the yarn. The term also is intended to include the use of differentially pre-colored component yarns, for instance spun-dyed, since they are inherently differentially dyeable whether colored additionally or not.

Where reference is made herein to a first yarn and to a second yarn, unless indicated otherwise, this does not exclude additional yarns which may or may not be differentially dyeable with respect to each of the first and second yarns. Also each first and second yarn may consist of more than one yarn end to provide a greater first or second yarn denier where desired.

In order to achieve a multicolor effect now popular in the carpet trade, the first yarn of this invention should comprise at least about 25% and no more than about 75% of the denier or weight of the resulting composite yarn.

Conventional hot fluid jet yarn bulking processes may be used for the cobulking step in the method of this invention. In such processes a yarn comprised of plasticizable filaments is bulked with a compressible fluid heated to a temperature which will plasticize the filaments. The bulking imparts a persistent crimp having a random, three-dimensional, curvilinear, extensible configuration continuously along the filaments. The yarn is fed into a high velocity stream of the hot turbulent fluid in a confined space at a speed which is greater than that at which it is withdrawn from the fluid, commonly by an overfeed amount of from about 10 to 200%, preferably more than about 30%. The crimped filaments may be allowed to cool freely in air, or in a cooling chamber as with a so-called stuffer-jet, or on a moving surface which is permeable to the fluid and separates the filaments therefrom. Such processes are particularly effective for crimping melt-spun synthetic polymeric filaments commonly used in commercial yarns, e.g., nylon, polyester, and polypropylene filaments. The bulked filaments in addition to having the random three-dimensional curvilinear crimp also have a randomly varying twisted configuration along the filament axis with portions in an S direction and alternate portions in a Z direction which provides outstanding bulk and aesthetics. Such twist is characterized by frequent portions of twist where the twist angle with respect to the filament axis is greater than 5° and which may be as high as 30°. Since the twist configuration of each filament varies randomly along its length the yarn made up of a group of these filaments, particularly if the filaments are of a nonround cross section, is prevented from packing in a closely nested configuration resulting in increased bulk even under compression.The character of such filaments is described in greater detail in U.S. Pat. Nos. 3,186,155 and 3,854,177, to Breen et al. A preferred bulking method for this invention is the jet-screen bulking method as described in U.S. Pat. No. 3,854,177 because of its ability to run at high yarn speeds of greater than 1,000 meters/minute. This method is particularly preferred when used in combination with a yarn-treating jet apparatus of the type described in U.S. Pat. No. 3,638,291 (Yngve) or 3,525,134 (Coon). Such jets are preferred for their efficiency and effectiveness at high speeds and for providing the desired uniformity, degree of bulk and filament intermingling without undesirable filament loops.

In the composite yarn products of this invention, the filaments of each component yarn are crimped and they are intermingled and entangled not only with other filaments of the same component but also in varying degrees with filaments of other component yarns (comingled). The filaments will not be entangled to the same degree in each yarn component. For example, because of the nature of the process the filaments of the first yarn will be less intermingled and entangled with one another than those of the second yarn, which have been previously subjected to a hot turbulent fluid bulking process and which provides some initial filament entanglement. This combination of entanglement among and between filaments and components provides a coherent yarn structure which is suitable for being handled directly by conventional textile machinery, and by carpet tufting machines in particular.

The method of this invention is particularly suitable for the preparation of heavy denier bulked continuous filament yarns within the range of from about 1500 to 5000 total denier and composed of two or more, preferably no more than three, differentially dyeable yarn components. In carpets, filament deniers within the range of 6 to 40, and particularly 15 to 25, are preferred because of the performance and aesthetics desired by the trade.

When combining a coupled spun and drawn yarn by this invention with a creeled yarn, the yarn components in the final product have different degrees both of true yarn twist and of filament entanglement. The first yarn is free of true twist and is free of any significant filament entanglement as it is supplied to the preheating zone, i.e., the draw rolls. The second yarn, and additional yarns fed in the same manner, has a low level of true twist imparted by taking the yarn off the end of a creeled yarn package, thus imparting one turn of twist for each length of yarn making one circumference of the package. This true twist is normally in the range of from about 1.0 to about 3.0 turns per meter and remains in the component in the combined yarn. This difference in twist possibly contributes to the desirable heather aesthetics achieved by this invention.

A preferred embodiment of the invention because of the good bulk and desirable heather obtained is one in which there is a difference in filament length between component yarns of at least 4%. This difference in length results from the differential change in length between the first and second yarn due to tension differences and to the previous hot fluid processing of the latter which results in it shrinking less during the cobulking step than the freshly drawn component. This difference in filament length is believed to aid in mixing of the filaments within the overall combined yarn bundle and to facilitate random cyclic surfacing of filaments along the yarn as well as to enhance dyeability differences under certain circumstances as described herein.

To retain the desired heather blending and to provide sufficient yarn coherency for processing, the cobulked yarn preferably has a cohesion as measured on automatic pin drop testing equipment (APDC) test of from 1.0–6.0 cm. This moderate level of cohesion allows greater bulk than that of some present commercial heather yarns of similar aesthetics and mixing which are produced by combining previously bulked yarns in an air jet at ambient temperature, as described for example in U.S. Pat. No. 4,059,873 (Nelson). The method of this invention provides substantially equivalent heather effects with less restrictive entanglement resulting in improved bulk in the final product. This improved bulk is observed for example in the products of this invention having a bundle crimp elongation (BCE) within the range of from 30 to 60%.

The products of this invention also can display improved package delivery characteristics over similar commercially available yarns having substantially similar heather properties and differential filament lengths in the yarn. Poor delivery of yarn from a package with erratic tension can produce breaks in the yarn or streaks in a carpet after tufting. Upon comparing three yarns of this invention to a control yarn prepared by combining previously bulked yarns with an air jet as described in the following paragraph, yarns of this invention gave from 3 to 20 times fewer package delivery plucks in the critical tension range of greater than 500 grams (where such high tensions can produce carpet nonuniformities).

As already mentioned, yarn bulk as measured by BCE can be substantially higher for the subject yarns than prior art yarns produced in a split process of bulking the individual yarns followed by combining the bulked yarns. For instance, a two component split process heather (control) yarn processed with a 6% overfeed in one yarn component with respect to the other and otherwise generally as described in U.S. Pat. No. 4,059,873 had a BCE after boil-off of 21.2% versus greater than 50% for a similar item prepared by this invention. This improved bulk can be used to provide adequate cover at lower carpet weights.

Whereas in a preferred embodiment of this invention the second yarn is supplied from a creel at a tension of less than about 1.0 grams/denier, tensions greater than this can be applied to assist in removal of filament entanglement from the creel yarn and to increase the retraction of the yarn in the cobulking zone. Also, shrinkage of the freshly drawn first yarn component can be reduced by decreasing the mechanical draw raio in the draw zone. By adjusting the relative shrinkages and retractions of these yarns in the cobulking zone, it is possible to provide a variety of effects as desired. Any desired combination of tension on the second yarn and draw ratio on the first yarn can be obtained through the use of separate or stepped rolls to control the yarn feeds to the preheating rolls. Attractive yarns can be produced in this manner over a broad spectrum of heather effects from relatively bold to soft.

The method of this invention comprises supplying an already bulked continuous filament second yarn, having a different dyeability or color with respect to a first yarn, into a common preheating zone and cobulking the second yarn with the first (unbulked) yarn in a coupled spin-draw-bulk process for manufacturing the first yarn. Tests show that the bundle cohesion and filament entanglement of the second yarn is reduced in the preheating step prior to the cobulking step. For example, using a method as represented in FIG. 1 with the draw rolls 9 being heated at 210° C. the coherency of the second yarn prepared by the method generally described in U.S. Pat. No. 3,854,177 changes from about 3.0 centimeters to about 10.0 centimeters APDC depending on the yarn tension of the second yarn arriving at the draw roll. Measurements of coherency on the first yarn from samples taken prior to cobulking show considerably less cohesion, for example greater than 28 cm. APDC. The spun yarn normally has a much higher shrinkage potential due to its high tension and orientation from drawing while the creeled yarn has already been relaxed in its previous bulking process.

The second yarn may be provided from a creel located in any convenient location such as from a second floor above, as represented in FIG. 1, or from a lower position than the draw rolls whereupon it is merely guided to substantially the same point for feeding onto the draw rolls in any convenient manner as represented in FIG. 2. The yarn may be passed from one floor or level to another by means of a grounded metal interfloor tube as shown in FIG. 1 with a ceramic exit guide made from known aluminum-silicon-magnesium ceramic material commonly used in yarn guides. In general, low friction change of direction guides can be used as necessary to control the yarn prior to its arriving at the draw rolls. Best operability has been found to occur when the creeled second yarn is maintained slightly separate from the spun-drawn first yarn on the heated rolls.

The amount of yarn overfeed between the draw rolls and the take-up roll following bulking, e.g., rolls 9 and 20 in FIG. 1, as determined by the differences between the respective roll surface speeds, is a key parameter relating to combined yarn bundle structure, yarn properties and resulting carpet appearance. It has been found that when conventional BCF nylon yarns are reprocessed alone through a "re-bulking" step very limited overfeeds are operable, for example, a maximum of only about 10%. Attempts to run at higher overfeeds result in unstable operation with difficulty in controlling the yarn on the screen. This low limit of overfeed is related to the low shrinkage potential of the previously jet treated yarn. The spun-drawn yarns by themselves have a much higher shrinkage potential upon undergoing the bulking operation and normally operate satisfactorily at overfeeds up to as high as 35% or more. With yarns having a maximum overfeed of 10% for the second yarn alone and 35% for the first yarn alone, the process of the invention is found to operate satisfactorily at an overfeed of up to 22%. Apparently the higher shrinkage force of the spun yarn tends to overfeed the lower-shrinking second yarn while stabilizing its operation. Since the second yarn has the higher coherency it tends to form a wandering core component which alternates with excess length along the cobulked yarn through the less cohesive bundle of filaments of the first yarn. This combination of the two yarns results in a tendency for the filaments of the first yarn to frequently appear on the surface of the combined yarn, even though they are shorter, and at times completely surround the more cohesive second yarn with an open sheath network of filaments through which the second yarn can still be seen.

The maximum overfeed operable in the process is dependent upon the temperature of the draw (pre-heating) rolls. At the temperature is increased in general, the overfeed can be increased. For example, in one test whereas a conventional 66-nylon carpet yarn as the second yarn was limited to 6.5% overfeed at a chest roll temperature of 190° C., processed alone, the overfeed could be increased to 10.6% at 210° C. roll temperature.

Increasing tension on the creeled yarn as it enters the preheating zone also tends to increase maximum operable overfeed with the effect being greater at higher roll temperatures.

Similarly, the maximum process overfeed is affected by draw ratio. As draw ratio is reduced at constant denier, the maximum overfeed is reduced and the difference in filament length of the second yarn with respect to the first yarn is proportionately lower. In other words, the relative length of the spun-drawn yarn filaments increases due to lower shrinkage in the spun-drawn yarn because of lower orientation and retraction as the draw ratio is reduced. For instance with 66-nylon at draw ratios below 1.8X the spun-drawn filaments have been observed to become longer than the creeled yarn filaments, even when the latter are supplied under low tension.

Tests run at a series of draw ratios with other process variables held constant show maximum bulk and color mixing occurring at a conventional high draw ratio of 3.0X with increasing boldness and reduced bulk being realized as the draw ratio is reduced.

With yarns of 66-nylon, preheating roll temperatures in the range of 190°–215° C. have provided highly satisfactory results. In general, higher bulk based on subjective carpet assessment and by the BCE test is realized at the higher end of the temperature range. This higher range, e.g., 210°–215° C., produced highly attractive heather.

The creeled second yarn can be subjected to high tension, such as greater than 1 gram per denier, to achieve more intimate blending of the component filaments. To help minimize yarn breakage under such conditions it is preferred to lengthen the zone in which the tension is applied in order to provide time for the filaments to disentangle themselves and become more equally aligned to bear the load. Cobulking of a highly tensioned creel yarn and a partially drawn spun yarn results in softer more highly blended heather yarns with much reduced boldness in carpets.

The method of this invention provides an easy route to substantially reduce the manufacturing cost of, and to increase production facilities for, bulked heather yarn products with little additional investment and through the use of existing coupled bulking process machinery.

The method provides yarns of uniform bulk and can provide a relatively constant BCE over a relatively wide range of preheat temperatures, creel tensions and draw ratios which is desirable from the standpoint of process control.

The use of a bulked yarn as a supply for the second yarn results in advantages compared to the method disclosed in U.S. Pat. No. 3,971,202 (Windley) in which the second yarn is a flat yrn, i.e., not bulked. Such advantages include high bulk and good process operability of the combined yarn, in spite of the limited maximum overfeed caused by the low shrinkage of the bulked second yarn. Use of a bulked second yarn also results in fewer yarn breaks from the creel at high speed than with drawn flat yarns as the second yarn, particularly at speeds of greater than 1,000 meters/minute. The discovery that conventional commercial coherent bulked continuous filament carpet yarns can be used as the second yarn without special treatment or preparation, such as disentangling, eliminates the need to prepare special bulked or flat yarns as the second yarn (in a yarn manufacturing facility normally equipped to produce bulked yarn products) thus minimizing costs.

The method of this invention is particularly useful for producing heather carpet yarns of low deniers in the range of about 1800 to 3500 because of its improved economics. Where separate facilities are required to make heather yarns, efficient use of such facilities favors the production of heavier denier yarns. Also, the improved bulk which can be realized by this invention provides good cover with light denier yarns further facilitating their use in light carpet constructions. The economics of the invention particularly favor the production of two color yarns, that is ones with only a first and second yarn. For nylon yarns, a preferred combination because of its versatility and appeal to the trade is the use of a cationically dyeable nylon with a deep acid dyeable nylon component. In this case it is preferred that the cationically dyeable yarn be the first yarn, i.e., the live spun-drawn component. Using the more dye sensitive deep dyeing yarn as the second yarn permits dye control testing prior to its being incorporated into the combined yarn helping to reduce waste.

The second yarn of this invention may itself be a cobulked yarn containing a third component such as an electrically conductive yarn to provide an antistatic effect to the cobulked yarn of this invention. The conductive yarn may be of the type described by Hull in U.S. Pat. No. 3,803,453 which has been introduced into the second yarn of this invention using the cobulking process of U.S. Pat. No. 3,971,202 (Windley).

The enhanced differential dyeability, e.g., between cationic and acid dyeable nylon filaments, obtainable by this invention can be used to economic advantage by employing a (less expensive) acid dyeable component having fewer amine ends than normal. For instance, a conventional regular acid dyeable 66-nylon BCF yarn when processed by the invention as the second yarn along with a cationic dyeable first yarn is found to be equivalent to a combined cat-dyeable and deep-acid dyeable yarn made using an ambient air jet to combine the previously bulked yarns; i.e., no significant shade difference is seen in carpets of these two yarns after cross-dyeing. The enhancement realized by the invention under such circumstances is equivalent to about 20 to 30 additional amine end groups in the acid-dyeable component. Expressed in another way, the process of this invention increases dye stepping between the first yarn and the second yarn by an average factor of about 1.5X when the fibers are dyed under mild conditions such as at low temperature and/or short holdup times.

This enhancement is due to a differential change in fiber structure between the component yarns, beyond their chemical dyeing characteristics. For example, a combination of cationic and regular-acid, or light-acid with regular-acid dyeable yarns prepared by the invention about equal the dye stepping of conventional cationic and deep-acid, or light-acid and deep-acid combinations, respectively, when the latter are made by conventional intermingling processes. This increased dye stepping can be diminished by leaving the dyed yarns in the dye bath longer than necessary to complete the dyeing; so care must be taken in selecting dyeing conditions when maximization of the effect is desired.

Because of this dye enhancement, yarns made by this invention can be dyed at a lower temperature or with shorter heating cycles to save energy. For example, in a Beck process, yarns of the invention were uniformly dyed in a cycle with the steam heating being on for only about 75 minutes versus 130 minutes for a standard cycle.

This improved dyeing is observed regardless of the dyeing type of nylon polymer employed (such as cationic, light-, regular- or deep-acid), of filament cross section, of filament draw ratios above about 2.0X, and of bulking fluid (superheated steam versus air). This enhancement however is significantly affected by tension on the second yarn as it is fed to the common draw roll. The dye stepping advantage diminishes as the creel tension is increased and becomes small when the tension is above about 1.0 gpd (0.9 dN/tex). It is preferred however to keep the creel tension on the second yarn below about 0.8 gpd (0.7 dN/tex). The best dye stepping is obtained at the lowest creel tension consistent with good process operability.

It is speculated that the enhanced differential dyeing provided by this invention depends to a considerable degree on the tension in the yarns between the draw roll and the bulking jet. This tension, commonly about 0.08 gpd (0.07 dN/tex), is provided by the forwarding action of the jet as necessitated by yarn overfeed to provide bulking. The jet pulls both the spun (first) yarn and the creeled (second) yarn away from the draw roll. The spun component shrinks much more than the creeled component upon leaving the draw rolls since it has been under drawing tension and has not yet been heat-relaxed as has the creeled yarn. Since the two components become entangled in the bulking jet, the creeled component cannot be pulled away by the jet any faster than the spun component, so it apparently goes slack between the draw roll and the bulking jet. Therefore, the pull or tension exerted on the creeled component by the jet is transferred to and borne by the spun first yarn, which therefore sees much greater tension than it would in the absence of the second yarn. This premise is consistent with the observation that the tenacity and modulus of the spun yarn are generally higher than they would be in the absence of the second yarn under equivalent conditions otherwise. Conversely, the tenacity and modulus of the creeled components are usually lower than that of the yarn before being "re-bulked".

In a screen bulking process, when the cobulked yarn of the invention is removed from the screen and placed under tension for winding, the shorter filaments of the first yarn are subjected to the entire winding tension. Therefore the winding tension on the first yarn will usually be higher than if produced alone. This winding tension tends to straighten and at least temporarily reduce crimp. Whereas this tension normally is not sufficient to destroy crimp, the crimp count frequency of the filaments of the first yarn may be reduced somewhat more than those of the second yarn. Consequently, excessively high tension during winding, which could permanently remove crimp and crimp recovery potential in the final yarn, should be avoided.

Contrary to the behavior of conventional plied intermingled yarns, in which one yarn component is the load bearing member and when under load tends to migrate to the center of the combined bundle, the filaments of the first yarn of this invention become entangled with and about the second yarn or yarns before such tension is applied. Thereafter, they are not free to migrate to the yarn center. It has been observed in yarns of the invention that in regions where the filaments of the first yarn surround the second yarn, tension on the composite yarn causes filaments of the first yarn to compress the longer filaments of the surrounded second yarn; which action can facilitate handling of the yarn such as making it easier to be inserted in a carpet backing during tufting or to be removed from a yarn package.

When operating at high yarn speeds such as greater than 1500 ypm (1371 mpm), to avoid sloughing of the creeled (second) yarn from an almost empty yarn tube when the yarn supply is transferring via a transfer tail to a new full yarn package it is desirable to use yarn tubes which have their surface coated with colloidal silica, such as "Ludox" colloidal silica (E. I. DuPont de Nemours and Company) for increased friction. For example, a 30% aqueous silica dispersion can be applied to the tube either by spraying or by dipping, followed by drying. The friction has been found to be sufficient when it will prevent a single tube from slipping when stacked on two side-by-side similarly coated tubes which are tilted at an angle of 30° to horizontal.

Unless otherwise specified, the following test methods were used to obtain data as reported herein. For some methods the yarn is conditioned prior to testing. Unless otherwise specified, when conditioning is called for it means that the sample is exposed for at least 2 hours in air at 21°±1° C. and 65% relative humidity just prior to testing.

Yarn denier is measured by removing the yarn from a package and slowly winding it on an 18 cm. long piece of cardboard with negligible tension. The yarn is aged at ambient room conditions for at least one week and then conditioned just prior to denier measurement. For the measurement, the sample is removed from the card, suspended on a vertical 90 cm. long cutter, loaded with a specified weight for at least three minutes for yarns having a denier no greater than 1900, and for at least six minutes for yarns having a denier above 1900, and then a 90 cm. length of yarn is cut. The specified weights are: 62 grams for yarns of no greater than 1,000 denier, 125 grams for yarns of greater than 1,000 and up to 2,000 denier, and 280 grams for yarns of greater than 2,000 denier. The cut sample is then weighed on an analytical balance. The weight of the sample in grams measured to 4 significant figures is multiplied by 1,000 to give the denier of the sample. Normally denier is given as the average of three such measurements.

Tensile properties of tenacity, elongation-at-break, initial modulus and toughness, before or after boil-off, are measured in the conventional manner using a tensile testing machine such as an "Instron" TM-1130 stress-strain analyzer having an automatic recorder and equipped with the appropriate load cell and air-operated clamps for holding the sample. The equipment is set for a 15.24 cm. sample length between the clamps and at an elongation rate of 100% per minute (i.e., 15.24 cm./min extension rate). For testing, the yarn sample is twisted 1.18 turns/cm. The values in grams/denier are calculated in the conventional manner.

Bundle crimp elongation (BCE) is the amount a boiled-off, conditioned yarn sample extends under 0.10 grams/denier tension, expressed as percent of the sample length without tension. A 50 cm. length ($L_1$) of the test sample in a relaxed condition is mounted in a vertical position. The sample is then extended by gently hanging a weight on the yarn to produce a tension of 0.10±0.02 gram/denier. The extended length ($L_2$) is read after the tension has been applied for at least three minutes. BCE, in percent, is then calculated as 100 $(L_2-L_1)/L_1$. Results are normally reported as averages of three tests per sample.

Crimp frequency and filament crimp index are determined using a 1500 mg. capacity Roller-Smith analytical balance (Biolar Corporation of North Grafton, Massachusetts). Crimp frequency is defined as the number of crimps per extended length in centimeters of a boiled-off, conditioned fiber while under 2 mg./denier tension and the extended length being measured under 50 mg./den. tension. A crimp is considered to be one complete crimp cycle characteristic of the samples crimp form (e.g., sinewave or helical turn). Filament crimp index is the difference in length of a boiled off, conditioned fiber measured (a) with 2 mg./den. tension versus (b) with 50 mg./den. tension, and is expressed as a percent of the extended length at 50 mg./den. tension. The balance is equipped with (1) a 100 mg. clamp hanging from the balance beam and (2) a vertically movable clamp, called a "transport" that has an associated vertical transport scale which permits measurement of the extension of the fiber to within 0.01 cm. The transport is adjusted so that the transport clamp and balance clamp just touch one another whereupon the vertical transport scale is read ($R_o$). The fiber sample is then mounted in the balance clamp and transport clamp, with the clamps positioned approximately 2 cm. apart. The transport clamp is then moved until the fiber is under 2 mg./den. tension. The transport scale is then read again ($R_1$) and the number of crimps (N) is counted with the aid of a 2X magnifying glass. The transport is then moved until the tension is 50 mg./den. and the transport scale read again ($R_2$). Crimp frequency is calculated as $N/(R_2-R_0)$ and filament crimp index is calculated as $100(R_2-R_1)/(R_2-R_0)$. The results are normally reported for the average of 20 fibers per sample.

Percent filament length difference (%FLD) after boil-off (ABO) is determined by placing one or more two-meter lengths of coiled yarn in a closed perforated stainless steel cup. The cups are then loaded into a pot containing a solution of $H_2O$ at ambient temperature (~25° C.) containing 1% (of the skein weight) "Alkanol" ACN wetting agent, 1% "Sevron" Red L (cationic) dye and 1% "Anthraquinone" Milling Blue B (acid) dye (for cat- and acid-dyeing nylon respectively). The solution is adjusted to 6.2 pH, brought to a boil, and maintained at boiling temperature for five minutes. The yarn cups are carefully removed and rinsed in clear $H_2O$ at ~25° C., then extracted via centrifuge and dried on a flat pan in an oven at 125° C. for one hour. The yarn cups are then placed in an ambient (18°-27° C.) storage area and cooled for one hour. A knot is tied about one meter from the end of each sample, and a first weight of 0.05 grams per denier is attached to the other end. The knotted end of the sample is attached to a clamp more than 2 cm. above the knot and the weighted sample is allowed to hang vertically for five minutes. It is cut 88 cm. below the knot and 2 cm. above the knot, both positions being determined while the sample is hanging with the weight attached. A dissecting needle is then used to separate the filaments of the spundrawn (first) yarn from the combined yarn near the end remote from the knot. The ends of these filaments are aligned and the terminal 1 cm. of one filament is trapped between the adhesive sides of a folded piece of tape. The knot is then clamped to the top end of a vertical measuring device calibrated in centimeters. A weight of 0.2 grams per denier is then attached to the folded tape. An operator supports the second weight in one hand and uses the other hand to slide the majority of the combined yarn upward along the spun-drawn filament in successive steps to within 15 cm. of the knot. The majority of the combined yarn is then slipped downward to 40 cm. from the knot, being careful not to stretch the spun-drawn filament. The weight is then allowed to hang freely, and the position of the top of the folded tape is measured within 5 seconds. The length of the spun-drawn filament is then recorded as "Spun-Drawn Filament Length" (cm.). Generally five filaments are tested and the results averaged and identified as "Average Spun-Drawn Filament Length" (cm.). The same procedure is then performed on the creeled (second) yarn filaments which are identified as "Average Creeled Yarn Filament Length" (cm.). "Percent Filament Length Difference" is calculated by the formula below.

Percent "Filament Length Difference" can be measured on two-component yarns before boil off by staining the cationic component in ambient temperature (25° C.) Sevron Red L dye solution followed by air drying at ambient temperature prior to cutting the yarn sample. The preferred practice is to utilize the "After Boil Off" procedure which most nearly simulates the yarn treatment in finished carpets.

$$\%\,FLD = \frac{\text{Length (cm) of Creeled Yarn Filaments} - \text{Length (cm) of Spun Yarn Filaments}}{\text{Length (cm) of Creeled Filaments}} \times 100$$

Relative Viscosity (RV) is the ratio of the absolute viscosity of a solution of 8.4 wt. percent 66-nylon or 6-nylon (dry weight basis) dissolved in formic acid (90% formic acid and 10% water) to the absolute viscosity of the formic acid solvent, both viscosities being measured at 25°±0.1° C. Prior to weighing, the polymer samples are conditioned for 2 hours in air at 50% relative humidity.

Yarn cohesion is measured using an automatic pin drop counter (APDC) of the type described and claimed in U.S. Pat. No. 3,290,932 (Hitt) with modifications as described in U.S. Pat. No. 3,563,021 (Gray) at Column 15, line 70 through Column 16, line 12. The apparatus is adjusted to give a tension on the yarn between the needle and the drive roll of 30±5 grams. The tension required to tilt the needle holder assembly is 80±5 grams.

EXAMPLE 1

This example represents a preferred embodiment of the invention in which the first yarn is a cationically dyeable yarn of 66-nylon and the second yarn is a bulked deep acid dyeable yarn of 66-nylon.

The yarns are cobulked in a process arrangement as represented in FIG. 1 except that the location of the supply package for the second yarn is located in the alternate position of 11' below rolls 9. The first yarn is of a conventional 66-nylon, poly(hexamethylene adipamide), polymer chemically modified to impart cationic dyeability and having a relative viscosity of 59. The yarn is spun from so-called "bright polymer" containing less than 0.03% of titanium dioxide as a delusterant. The yarn contains 68 filaments of about 19 denier per filament after drawing. The filaments have a symmetrical trilobal cross section with a modification ratio of 2.3. The filaments are spun at a temperature of about 290° C. and quenched with air in a conventional manner. An aqueous finish is applied by means of a finish roll (not shown) just prior to feed roll 4. Feed roll 4 controls the spun yarn speed at 457 meters per minute. Draw rolls 9 have a surface temperature of 210° C. and a surface speed of 1376 meters per minute giving a draw ratio of 3.0X. With 9½ wraps on rolls 9 yarn 1 is preheated and advanced to jet 18 of the type described in U.S. Pat. No. 3,638,291. Jet 18 is supplied with air at 245° C. at a pressure of 12.0 atm. gauge.

The second yarn is 66-nylon which is deep acid dyeable from a high concentration of amine ends, semi-dull luster due to 0.15% titanium dioxide, and is a bulked coherent yarn having been bulked by a plasticizing hot turbulent fluid in the manner described in U.S. Pat. No. 3,854,177 (Breen et al.) using an air temperature of 185° C. This yarn has a denier of 1350 and contains 68 filaments with a symmetrical trilobal cross section having a modification ratio of 2.3. The yarn before boil-off has a tenacity of 3.5 grams/denier (gpd), an elongation at break of 37%, an initial modulus of 9.9, and a coherency of 3.61 cm. APDC. After boil-off the second yarn has a denier of 1383, a tenacity of 3.42 gpd, an elongation of 47%, a modulus of 6.51, a boil-off loop shrinkage of 3.44, a BCE of 32.8%; a crimp frequency of 1.46 $cm^{-1}$, and a filament crimp index of 16.12.

Rolls 9 have a surface temperature of 210° C. and a surface speed of 1376 meters per minute. The two yarns are kept separate from each other as they arrive at rolls 9 by adjusting the position of guide 15. Tension on second yarn 10 between guide 15 and rolls 9 ranges between 100 to 200 grams (0.07 to 0.15 grams per denier) due to variation in drag of yarn 10 across the surface of supply package 11. Second yarn 10 is also preheated by rolls 9. Both yarns pass with 9½ wraps on rolls 9 and are advanced to jet 18. The combined cobulked yarn is removed from jet 18 by a moving screen on drum 19 with a surface speed of 55.0 meters/minute and is held on the screen by a vacuum inside the drum. Take up roll 20 with a surface speed of 1105 meters/minute removes the cobulked yarn from the screen and advances it to windup 23 where it is wound a tube at 1178 meters/minute.

All the filaments of the resulting cobulked yarn have random, three-dimensional curvilinear crimp with alternating regions of S and Z filament twist with frequent twist angles of greater than 5° with respect to the filament axis. The filaments of the first yarn are observed to be generally less coherent than those of the second yarn and are frequently located along the surface of the cobulked yarn bundle.

Before boil off the cobulked yarn has a denier of 2934, tenacity of 2.39 grams/denier, 49% elongation, 4.66 modulus, and 1.65 cm. APDC. After boil off the yarn has 49% BCE, 2.55 crimps per cm., 5.79% loop shrinkage and a filament crimp index of 19.25. Filaments of the yarn have a filament length different (FLD) of 6.7% with the filaments of the second yarn being longer than those of the first yarn.

The yarn is tufted into a level loop style carpet construction using a commercial nonwoven polypropylene primary backing and a one-tenth inch tufter gauge, three-sixteenths inch pile height to give a carpet weight of 20 ounces per square yard. The carpet is beck dyed with acid and cationic dyes to give a multicolor effect. The dyed carpet has an attractive random nondirectional heather-like coloration free of patterning and streaks.

EXAMPLE 2

This example is similar to Example 1 except that the yarn polymer compositions and filament cross sections are different, thus providing different yarn aesthetics.

The first yarn is spun and drawn to provide 68 filaments of 19 denier per filament of regular acid dyeable 66-nylon or bright luster and having a relative viscosity of 59 and 56±4 amine ends (eq./$10^6$ gm). The filaments have a trilobal cross section with a modification ratio of 2.3. The method is arranged as represented in FIG. 2. A conventional lubricating aqueous yarn finish is applied to the cooled yarn prior to feed rolls 4 which are running at a surface speed of 689 meters/minute. Rolls 9 have a surface temperature of 170° C. and a surface speed of 1950 meters/minute to draw the yarn 2.83X.

The second yarn is a 66-nylon cationic dyeable (80±8 sulfonic eq., 51.0 amine ends, 64 RV) semi-dull (0.15% titanium dioxide delusterant) continuous filament yarn which has been bulked at 2112 meters/min. from rolls heated to 220° C. with a hot turbulent fluid by the method of U.S. Pat. No. 3,854,177 using air at 230° C. and at a pressure of 7.5 atm. psig. The yarn is supplied from the end of a stationary package held in a creel at a position below draw rolls 9. The filaments have 4 continuous voids and a quadrilateral cross section as described in U.S. Pat. No. 3,745,961. The second yarn has a nominal denier of 1218 and contains 80 filaments. Before boil-off the yarn has a tenacity of 3.11 grams/denier, elongation at break of 51%, an initial modulus of 7.05 and a cohesion of 3.70 cm. APDC. After boil-off the yarn has a denier of 1225, a tenacity of 2.95, elongation of 51%, modulus of 6.05, boil-off loop shrinkage of 4.08%, BCE 72%, crimp frequency 2.17 per centimeter, and filament crimp index 20.78.

Both yarns pass around draw rolls 9 with 9½ wraps and are advanced to jet 18 which is of the type described in U.S. Pat. No. 3,638,291 (Yngve) which is supplied with air at 185° C. at 9.2 atm. gauge pressure. The combined cobulked yarn is removed from the jet on a moving screen with a surface speed of 180.5 meters/minute and is held on the screen by a vacuum inside the drum. Filament cooling on the drum is aided by a water mist quench sprayed at a rate of 90 ml./min. Take-up roll 20 is running with a surface speed of 1768 meters/minute to remove the yarn from the screen and providing an overfeed between draw rolls 9 and take-up roll 20 of 10.3%. The yarn is wound up at 1834 meters/minute. The two yarns are kept separate from each other as they arrive at roll 9 by the position of guide 15. Tension on the second yarn between guide 15 and rolls 9 is 100 to 200 grams total (0.08 to 0.16 grams per denier), the variation being due to variation in drag of yarn 10 across the surface of supply package 11. The filaments of both component yarns in the cobulked yarn have random, three-dimensional, curvilinear crimp with frequently alternating regions of S and Z filament twist.

The cobulked yarn contains 148 filaments and before boil-off has a denier of 2565, tenacity 2.68 grams/denier, 45% elongation, 7.15 modulus, cohesion of 3.30 cm. APDC. After boil-off the yarn has a tenacity of 2.50 grams/denier, 50% elongation, 4.63 modulus, 39.9% BCE, 5.86% loop shrinkage, 2.09 crimps per cm., filament crimp index 17.08 and a filament length difference of 5.32% with the filaments of the cationic dyeable yarn being the longer.

The cobulked yarn is tufted into a level loop style carpet using a commercial nonwoven polypropylene primary backing, ⅛ inch gauge ¼ inch pile height to give a carpet weight of 24 ounces per square yard. The carpet is dyed in a beck with multicolor acid and cationic dyes to give a yellow/orange-brown heather-like random mixed coloration and luster. The carpet has a pleasing nondirectional appearance.

The cobulked yarn is also tufted into a cut and loop pile mixed-lustre style carpet with the same type backing using 3/16 inch gauge, ¾ inch cut and ¼ inch loop pile height to give a carpet weight of 25 ounces per square yard. The carpet is disperse dyed in a beck to a solid blue shade giving a carpet with a pleasing mixed lustre appearance instead of differential coloration.

EXAMPLE 3

This example, of another preferred product, also employs a method as represented in FIG. 2.

The first (spun-drawn) yarn is a 66-nylon cationic dyeable semi-dull continuous filament yarn containing 80 filaments per threadline of 15 denier per filament and the second (creeled) yarn is a 66-nylon deep acid dyeable dead bright continuous filament bulked yarn containing 64 filaments per threadline of 19 denier per filament. Process conditions are shown in Table I-A and polymer and yarn properties as listed in Table I-B.

Carpet construction specifications for a level loop tufted carpet made from the yarn are listed in Table I-C. The carpet has attractive random heather-like coloration when piece dyed in an acid and cationic dye solution. A carpet of similar yarn dyed in a reduced energy beck dye cycle dyes acceptably whereas a control carpet made from similar ambient air entangled yarns dyes nonuniformly and is unacceptably light in color.

TABLE I-A

| Process Variable | Process Specifications: Cobulked Process | Creeled Yarn Component |
|---|---|---|
| Yarn Type | 1225-854 | 1245-757A |
| Spin Block, T°C. | 292 | 290 |
| Throughput per Hole g/m/s | 2.9 | 4.1 |
| Quench Air, T°C./RH % | 5.0/80 | 10.0/80 |
| Quench Air Flow ($m^3$/min.) | 10.6 | 11.3 |
| Primary Finish/Conc. | 7% | 8% |
| Finish Roll Speed, rpm | 25 | 35 |
| Feed Roll Speed, m/m | 782 | 750 |
| Draw Roll Wraps | 9.5 | 9.5 |
| Draw Roll, T°C. | 215 | 216 |
| Draw Roll Speed m/m | 2035 | 2174 |
| Mech. Draw Ratio | 2.6 | 2.9 |
| Jet Type | X-Z* | D-I** |
| Jet Air Temp., °C. | 240 | 230 |
| Jet Air Pressure (atm) | 10.6 | 7.5 |
| Bulking Drum Speed (m/m) | 95.8 | 77.8 |
| Take-up Roll Speed (m/m) | 1788 | 1820 |
| Secondary Finish/Conc. | 15% | 20% |
| Mist Quench Flow Rate (ml/min.) | 90 | 90 |
| Wind-up Speed (m/m) | 1898 | 1911 |
| Wind-up Tension (g) | 450 | 275 |

*As described and claimed in U.S. Pat. No. 3,638,291 (Yngve)
**As described and claimed in U.S. Pat. No. 3,525,134 (Coon)

TABLE I-B

| | Spun Component | Creeled Component | Cobulked Product |
|---|---|---|---|
| Product Before Boil-Off | | | |
| Relative Viscosity | 49 | 64 | N/A |
| Cross-section | *H.F. | H.F. | H.F. |
| Bundle Denier | **1225 | 1256 | 2493 |
| Number of Filaments | 80 | 64 | 144 |
| Tenacity, gpd | N/A | 3.05 | 2.86 |
| Elongation, % | N/A | 51 | 51 |
| Modulus | N/A | 7.23 | 6.83 |
| Cohesion (APDC), cm. | N/A | 6.72 | 3.30 |
| Dye Type | Cationic | Deep Acid | Cat./Dp. Acid |
| Luster | Semi-dull | Dead Bright | Semi-dull/ Dead Bright |
| Finish on Yarn (%) | N/A | 1.16 | .63 |
| Product After Boil-Off | | | |
| Bundle Denier | 1255 | 1271 | 2539 |
| Number of Filaments | 80 | 64 | 144 |
| Tenacity, gpd | N/A | 2.79 | 2.74 |
| Elongation, % | N/A | 53 | 55 |
| Modulus | N/A | 5.51 | 4.76 |
| Boil-Off Loop Shrinkage | N/A | 4.02 | 5.62 |
| Bundle Crimp Elongation | N/A | 70.1 | 57.4 |
| Crimp Frequency, cm.−1 | N/A | 3.94 | 2.68 |
| Filament Crimp Index | N/A | 18.15 | 15.42 |
| Filament Length Difference, % | N/A | N/A | 9.50 |
| Polymer Flake Properties | | | |
| Type | 854 | 757 | |
| Relative Viscosity | 34 ± 3 | 40 ± 3 | |
| Amine Ends ($NH_2$) | 40 ± 4 | 82 ± 4 | |
| $TiO_2$, % | 0.15 | <.012 | |
| Sulfonate Equivalents, $SO_3$ | 78 ± 6 | 0.0 | |

*Hollow Filament (4-voids)
**Nominal Denier

TABLE I-C

| | |
|---|---|
| Style | Level Loop |
| Tufter Gauge | ⅛" |
| Pile Height | ¼" |
| Weight, Oz./Yd.$^2$ | 22.4 |
| Primary Backing | "Typar" |
| Secondary Backing | None |
| Dye Type | Heather Audit (Yellow, Orange Brown) |
| Dye Process | Beck |

EXAMPLE 4

This example is of a three-color yarn of the invention.

The first (spun-drawn) yarn is a 66-nylon light dyeable semi-dull continuous filament yarn containing 68 filaments of trilobal cross section per threadline having 20.4 denier per filament; second and third yarns are combined in a process as generally shown in FIG. 1. The second (creeled) yarn is a 66-nylon deep acid dyeable dead bright continuous filament bulked yarn containing 92 filaments per threadline of 5.4 denier per filament. The third (creeled) yarn is a 66-nylon cationic dyeable dead bright continuous filament bulked yarn containing 92 filaments per threadline of 5.4 denier per filament. Process specifications are as specified in Table II-A. Yarn and polymer properties are listed in Table II-B, and carpet construction specifications for a level loop carpet made from the yarn are listed in Table II-C. the carpet has attractive nondirectional random heather-like three-color aesthetic when piece dyed.

TABLE II-A

| Process Variable | Cobulked Product | Creeled Yarn 1 (500-747) | Creeled Yarn 2 (500-744) |
|---|---|---|---|
| Spin Block, T°C. | 290 | 295 | 295 |
| Throughput per Hole, g/m/s | 2.68 | 0.70 | 0.62 |
| Quench Air, T°C. | 6.1 | 12.8 | 12.8 |
| Quench Air Flow | 10.6 | 10.3 | 10.3 |
| Primary Finish/Conc. | 9% | 10% | 10% |
| Finish Roll Speed | 27 | 28 | 25 |
| Feed Roll Speed, m/m | 450 | 786 | 695 |
| Draw Roll Wraps | 9 | 7.5 | 7.5 |
| Draw Roll, T°C. | 210 | 210 | 212 |
| Draw Roll Speed, m/m | 1405 | 2432 | 2154 |
| Mech. Draw Ratio | 3.1 | 3.1 | 3.1 |
| Jet Type | X-Z | DI | DI |
| Jet Air Temp. °C. | 260 | 225 | 235 |
| Jet Air Pressure (atm) | 135 | 125 | 125 |
| Bulking Drum Speed (m/m) | 56.3 | 70 | 70 |
| Take-up Roll Speed (m/m) | 1029 | 2084 | 1847 |
| Secondary Finish/Conc. | 15% | 20% | 20% |
| Mist Quench Flow (ml/min) | 90 | 90 | 90 |
| Wind-up Speed (m/m) | 1113 | 2167 | 1920 |
| Wind-up Tension (g) | 275 | 150 | 150 |

TABLE II-B

| | Spun-Drawn (1350-845) | Creeled Yarn 1 (500-747) | Creeled Yarn 2 (500-744) | Cobulked Yarn (L-4) |
|---|---|---|---|---|
| Product Before Boil-Off | | | | |
| Modification Ratio | 2.3 | 2.0 | 2.0 | 2.3/2.0 |
| Bundle Denier | *1350 | 478 | 512 | 2258 |
| Number of Filaments | 68 | 92 | 92 | 252 |
| Tenacity, gpd | N/A | 3.70 | 3.30 | 2.72 |
| Elongation | N/A | 36 | 39 | 48 |
| Modulus | N/A | 12.38 | 10.58 | 6.48 |
| Cohesion (APDC), cm. | N/A | 7.05 | 5.60 | 2.23 |
| Dye Type | Light Acid | Deep Acid | Cati-onic | Light/ Deep/Cat. |
| Luster | Semi-dull | Bright | Bright | Mixed |
| Finish on Yarn | N/A | 0.90 | 0.90 | 0.46 |
| Product After Boil-Off | | | | |
| Bundle Denier | 1423 | 482 | 516 | 2359 |
| Number of Filaments | 68 | 92 | 92 | 252 |
| Tenacity, gpd | N/A | 3.61 | 3.12 | 2.61 |
| Elongation, % | N/A | 39 | 41 | 53 |
| Modulus | N/A | 9.51 | 7.91 | 5.30 |
| Boil-Off Loop Shrinkage | N/A | 3.06 | 3.89 | 3.88 |
| Bundle Crimp Elongation, % | N/A | 50.0 | 50.0 | 45.0 |
| Crimp Frequency, cm. $^{-1}$ | N/A | 2.55 | 2.64 | 2.0 |
| Filament Crimp Index | N/A | 13.69 | 17.41 | 15.25 |
| Filament Length Difference, % | N/A | N/A | N/A | 13.4 |
| Polymer Flake Properties | | | | |
| Type | 845 | 747 | 744 | |
| Relative Viscosity | 37 | 40.0 | 51.2 | |
| Amine Ends ($NH_2$) | 30 | 82.0 | 55.5 | |
| $TiO_2$, % | 0.15 | <.012 | <.012 | |
| $SO_3$ | 0 | 0 | 80 ± 8 | |

*Nominal Denier

TABLE II-C

| CARPET CONSTRUCTION | |
|---|---|
| Style | Level Loop |
| Tufter Gauge | 1/10" |
| Pile Height | 3/16" |

TABLE II-C-continued

| CARPET CONSTRUCTION | |
|---|---|
| Weight, Oz./Yd.$^2$ | 20 |
| Primary Backing | "Typar" |
| Secondary Backing | None |
| Dye Type | Acid/Cationic |
| Color | Red/Green |
| Dye Process | Beck |

EXAMPLE 5

This example demonstrates the effects of creeled (second) yarn tension on yarn speeds and temperatures just prior to the bulking jet in a process of the invention. The process arrangement is substantially as represented in FIG. 2 except that for tension control the second yarn is introduced into the process form a separate set of feed rolls to draw pins 5 and then ¼ inch pin is used to keep the first and second yarns separate from one another to facilitate measurement just prior to the bulking jet. The first and second yarn filament characteristics and the process conditions are substantially as described in Example 3. Yarn temperature measurements are taken 3 inches before the entrance to the bulking jet and yarn velocity measurements about 4 inches before the bulking jet. Yarn speed measurements are made using a Laser Doppler Velocimeter and yarn temperature measurements are made via a Barnes Infrared Microline Scanner. Measurements are taken with the first yarn being produced at two different draw ratios, 2.0X and 3.0X, and with creel yarn tensions adjusted over a range of 150 to 1500 grams/denier as measured just before the hot crest rolls. The temperature of these heated rolls is 215° C. and their surface speed is 2300 ypm (2103 m/m). The results are summarized in Table III.

TABLE III-A

| Yarn Tension Before Hot Chest | Spun Live (First Yarn) Temperature °C. Low | Median | High | Velocity YPM |
|---|---|---|---|---|
| | Draw Ratio 3.0X | | | |
| 150 gm | | 205 | | 2115 |
| 300 gm | | | | 2115 |
| 500 gm | | 203 | | 2153 |
| 750 gm | | | | 2134 |
| 1000 gm | 179 | 184 | 195 | 2162 |
| 1250 gm | | | | 2186 |
| 1500 gm | 199 | 201 | 205 | 2115 |
| | Draw Ratio 2.0X | | | |
| 150 gm | | | | 2200 |
| 300 gm | | | | 2223 |
| 500 gm | | | | 2237 |
| 750 gm | | | | 2148 |
| 1000 gm | 184 | 197 | 203 | 2209 |
| 1250 gm | | | | 2237 |
| 1500 gm | | | | 2233 |

| Yarn Tension Before Hot Chest | Spun Live (First Yarn) Range YPM | Spread YPM |
|---|---|---|
| | Draw Ratio 3.0X | |
| 150 gm | 1927-2350 | (423) |
| 300 gm | 1927-2280 | (323) |
| 500 gm | 1993-2312 | (319) |
| 750 gm | 1946-2327 | (381) |
| 1000 gm | 1951-2369 | (418) |
| 1250 gm | 2026-2369 | (343) |
| 1500 gm | 1951-2256 | (305) |
| | Draw Ratio 2.0X | |
| 150 gm | 1998-2406 | (409) |
| 300 gm | 2054-2369 | 315 |
| 500 gm | 2059-2421 | 362 |
| 750 gm | 1983-2397 | 390 |

TABLE III-A-continued

| | | |
|---|---|---|
| 1000 gm | 2021–2397 | 376 |
| 1250 gm | 2092–2397 | 306 |
| 1500 gm | 2021–2444 | 423 |

| Yarn Tension Before Hot Chest | Creel (Second Yarn) Temperature °C. Lowest | Median | Highest |
|---|---|---|---|
| | Draw Ratio 3.0X | | |
| 150 gm | 118 | 135 | 156 |
| 300 gm | | | |
| 500 gm | 129 | 160 | 179 |
| 750 gm | | | |
| 1000 gm | 169 | 177 | 182 |
| 1250 gm | | | |
| 1500 gm | 179 | 179 | 185 |
| | Draw Ratio 2.0X | | |
| 150 gm | | | |
| 300 gm | | | |
| 500 gm | | | |
| 750 gm | | | |
| 1000 gm | 168 | 188 | 197 |
| 1250 gm | | | |
| 1500 gm | | | |

| Yarn Tension Before Hot Chest | Creel (Second Yarn) Velocity YPM | Range YPM | Spread YPM | Difference In Velocity Of Creel-Live YPM |
|---|---|---|---|---|
| | Draw Ratio 3.0X | | | |
| 150 gm | 2195 (Modal) (2326) (Median) | 2059–2604 | (545) | 80 (Modal) 211 (Median) |
| 300 gm | 2275 | 2002–2538 | (536) | 160 |
| 500 gm | 2350 | 2112–2688 | (576) | 197 |
| 750 gm | 2247 | 1904–2627 | (723) | 113 |
| 1000 gm | 2153 | 1979–2397 | (418) | −9 |
| 1250 gm | 2190 | 2007–2350 | (343) | 4 |
| 1500 gm | 2096 | 1904–2257 | (352) | −19 |
| | Draw Ratio 2.0X | | | |
| 150 gm | 2256 | 2139–2435 | 296 | 56 |
| 300 gm | 2256 | 2077–2421 | 343 | 33 |
| 500 gm | 2218 | 1974–2430 | 456 | −19 |
| 750 gm | 2233 | 1974–2477 | 503 | 85 |
| 1000 gm | 2162 | 1857–2406 | 550 | −47 |
| 1250 gm | 2049 | 1777–2374 | 597 | −188 |
| 1500 gm | 2171 | 1951–2383 | 432 | −62 |

The data show that the temperature of the second yarn is a function of its tension. At low tension, it has a low mean value and a large range, for example, at 150 gram tension from 118° C. to 156° C. with a mean value of 135° C. As the tension increases to 1500 grams, the second yarn temperature reaches a steady state value of 180° C. and its range is reduced to 179° C. to 185° C. An explanation is that crimp in the yarn at lower tension inhibits contact with the surface of the hot rolls. The temperature of the first yarn when two ends of it are running and no creeled second yarn, is about 205° C. with a narrow range of ±1° C. The temperature of the first yarn begins to vary as the tension of the second yarn increases over 1000 gram tension. The speed of the second yarn is higher than the roll speed at 150–500 grams tension, possibly due to crimped straightening and removal of entanglement on the rolls. At higher tensions, the second yarn speed is reduced apparently as a result of increased stretch-related retraction.

Crimp frequencies after boil-off in the second yarn are higher than in the first yarn at creeled yarn tensions below 1000 grams. As creeled yarn tension is increased, crimp in the creeled yarn is pulled out and roll temperature is reduced due to increased loading, causing a reduction in crimp in both yarn components. Crimp variance in the second yarn is highest at the lowest creel tension. Crimp variance of the total yarn bundle follows a similar but less significant trend. Percent filament length difference decreases linearly with increased creeled yarn tension from 9.9% at 150 grams to 0.1% at 1500 grams in the 3.0X draw ratio process. In the 2.0X draw ratio process the reaction of the first yarn decreases and at second yarn tensions greater than 500 grams the speed of the second yarn becomes less than that of the first yarn giving a percent FLD of about 0 and becoming negative at higher tensions. Bundle crimp elongation remains unexpectedly uniform over the entire series at both 3.0X and 2.0X. For the 3.0X draw ratio series, the effect of the creeled yarn tension on percent FLD and on dye-stepping (as discussed in detail in Example 6) are shown in Table III-B.

TABLE III-B

| Creel Tension (g/d) | % FLD | Modulus Spun (T-854) | Creel (T-757A) | % Difference |
|---|---|---|---|---|
| 0.12 | 9.9 | 8.37 | 6.84 | 22.3 |
| 0.25 | 8.6 | 8.27 | 6.94 | 19.1 |
| 0.40 | 7.2 | 8.37 | 7.76 | 7.8 |
| 0.60 | 7.7 | 9.08 | 6.94 | 30.8 |
| 0.80 | 3.3 | 8.37 | 7.04 | 18.9 |
| 1.02 | 1.5 | 8.27 | 8.16 | 1.3 |
| 1.24 | 0.1 | 8.37 | 8.06 | 3.8 |

| Creel Tension (g/d) | Dye on Fiber Deep (%) | Cat (%) | Dye Stepping |
|---|---|---|---|
| 0.12 | — | — | — |
| 0.25 | 2.795 | 0.77 | 3.63 |
| 0.40 | 2.68 | 0.655 | 4.09 |
| 0.60 | 2.89 | 0.79 | 3.66 |
| 0.80 | 2.795 | 0.87 | 3.21 |
| 1.02 | 2.66 | 0.85 | 3.13 |
| 1.24 | 2.185 | 0.885 | 2.47 |

Within method error, dye stepping with color index acid blue 40 appears to be independent of creel tension up to about 0.6 grams/denier. Then dye stepping appears to drop slowly in the range of about 0.8 to 1.0 grams/denier and rapidly beyond 1.0 grams/denier.

EXAMPLE 6

This example demonstrates the effect of the process of the invention under conditions substantially as used in Example 3 on dye stepping between various first and second yarns, both of 66-nylon, compared to the same yarn composition made by cold air intermingling of the same yarn component as taught in U.S. Pat. No. 4,059,873 (Nelson).

The dye used is C.I. Acid Blue 40, sold by Du Pont under the trade name "Merpacyl" Blue 2GA. An equivalent product is "Tectilon" Blue 2GA sold by Ciba-Geigy. Dyeings are carried out in a Model WBRG 3 "Vista-Matic" sample dyer made by Ahiba Apparatebau, Birsfelden, Switzerland. Five grams of yarn is wound on one of the stirring rods provided and prescoured with agitation for at least 20 minutes at 80° C. in 200 ml. of an aqueous solution containing 1.0 grams/liter sodium perborate and 0.25 grams/liter "Igepon" T-51. The stirring rods are then removed from the dyer and the yarn rinsed first 5 times with tap water, then 5 more times with distilled water taking care to squeeze most of the excess liquid from the yarn after each rinse. The yarn is then stored while still on the stirring rod in a closed plastic bag to prevent it from drying out until it is dyed.

A calibration curve for the dye is established as follows: A stock solution of 0.25 g/L of the standardized dye in menol is prepared. Menol is a solvent for 66-nylon and consists of 85% phenol (redistilled from potassium carbonate in a nitrogen atmosphere) and 15% methanol (reagent grade). A reagent blank is prepared by dissolving 20 mg. of undyed 66-nylon yarn in 25 ml. menol. Four standard solutions are prepared by diluting 1,2,5 and 8 ml., respectively, of the stock solution with menol to 25 ml. To each standard solution is added 20 mg. of 66-nylon yarn. The absorbence of the 4 standard solutions at 630 nm is measured with a Bausch and Lomb "Spectronic" 21 spectrophotometer (Model DV) using Bausch and Lomb 10 mm. test tube cuvettes. The absorbence of the solvent is subtracted by first zeroing the instrument with a cuvette filled with the above reagent blank in the light path. The absorbences of the dye in the 4 solutions is, respectively, 0.095, 0.189, 0.474, and 0.756. From these the slope factor is calculated to be 9.454 L/g with a correlation coefficient of 0.999997.

Prescoured yarn samples are dyed for about 24 hours with agitation at room temperature (20°-23° C.) in 200 ml. of a dye bath containing 0.5 g/L dye and 5.0 g/L monosodium phosphate monohydrate. Before use, the pH of the dye bath is adjusted to 6.0 by adding NaOH solution as required. After dyeing, the yarn samples are removed from the dye baths, rinsed 5 times with tap water and 5 times with distilled water and then dried—while still wound on the stirring rods—for about 3 hours at 105° C. Portions of the dyed heather yarns are then separated into their components under a magnifying glass. The identity of the components is usually obvious. The only exception in this case are samples 8A and 8B where staining with a cationic dye was used to establish which of the two lighter dyeing components was the cat dyeable and which the light dyeable one.

Percent dye on fiber is then measured by dissolving about 20 mg. of fiber in 10 ml menol and measuring the absorbence at 630 nm as described above after zeroing the instrument with the reagent blank to subtract the absorbance of the solvent:

$$\% \text{ dye on fiber} = \frac{\text{absorbance} \times 1000}{9.454 \times \text{sample wt in mg.}}$$

Results are shown in Table IV. Col. 1 is the sample identification. Col. 2 identifies the components of the yarn by commercial type numbers to identify the type of polymer and filament cross section. LDR stands for 2.6X draw ratio—all others are drawn 3.0X. SB stands for steam bulked—all others are bulked with hot air. The underlined component in Col. 2 is the one which is spun during the process; the other component(s) is the creeled second yarn of the invention. For Sample 7D instead of intermingling, the two component yarns are wound side-by-side on the stirring rod; this is indicated by using the symbol + instead of /.

Col. 3 shows percent dye on fiber in the same order as the components shown in Col. 2. Some of the numbers are of single measurement; others are averages of 2 or more measurements. Samples 1C, 3C, and 4C could not be separated into their respective components because no shade difference could be detected. In these three cases, the total yarn was analyzed for dye on fiber and the value given is the average of the two components.

In all cases, the process of the invention unexpectedly results in less dye on fiber in the spun component and, with one exception, more dye on fiber in the creeled component. The one exception represents a steam bulked deep dyeable yarn which apparently is already so dyeable that rebulking it does not seem to have any effect.

Col. 4 shows dye-on-fiber of the second item of Col. 3 divided by dye-on-fiber of the first item given in Col. 3. In the case of Samples 8A and 8B the two numbers given are dye-on-cat yarn divided by dye-on-light and dye-on-deep yarn divided by dye-on-light, respectively. Note that this ratio in Col. 4 which is a direct measure of dye stepping is greater for Sample 1A (spun cat, creeled regular) than for Sample 2B (comingled cat and deep). Also, the ratio for Sample 3A (spun light, creeled regular) is greater than for Sample 5B (comingled light and deep).

Col. 5 shows the ratio for the A sample (produced by the process of the invention) divided by the ratio for the corresponding B sample (produced by simple air comingling). This value shown in col. 5 then is the factor by which dye stepping is enhanced by the process of the invention. Although the enhancement values shown have a high variability, analysis of variance shows that the variability can be attributed almost completely to the variability of the dye-on-fiber values.

TABLE IV

DYE-ON-FIBER - C. I. ACID BLUE 40

| 1 Sample | 2 Composition | 3 Dye-on-Fiber | 4 Dye Stepping | 5 Enhancement |
|---|---|---|---|---|
| 1A | 754/756 | 0.41/2.00 | 4.88 | |
| 1B | 754/756 | 0.49/1.86 | 3.90 | 1.28 |
| 1C | 754/756 | 1.10 avg. | ≦2 | |
| 2A | 754/757 | 0.29/2.41 | 8.31 | |
| 2B | 754/757 | 0.56/2.26 | 4.04 | 2.06 |
| 2C | 754/757 | 0.60/2.05 | 3.42 | |
| 3A | 755/756 | 0.51/2.48 | 4.86 | |
| 4B | 755/556 | 0.76/1.79 | 2.36 | 2.06 |
| 3C | 755/756 | 1.28 avg. | ≦2 | |
| 4A | 755/757 | 0.68/2.51 | 3.69 | |
| 5B | 755/757 | 0.81/2.22 | 2.74 | 1.35 |
| 4C | 755/757 | 1.48 avg. | ≦2 | |
| 5A | 744/747 | 0.60/1.72 | 2.86 | 1.20 |
| 6B | 744/747 | 0.61/1.45 | 2.38 | |
| 6A | 754/757LDR | 0.38/3.05 | 8.03 | 1.65 |
| 3B | 754/757LDR | 0.54/2.63 | 4.87 | |
| 7A | 754SB/757SB | 0.52/3.10 | 5.96 | 1.23 |
| 7D | 754SB + 757SB | 0.65/3.15 | 4.85 | |
| 8A | 744/755/747 | 0.73/0.56/3.20 | 1.27/4.95 | 1.31/1.20 |
| 8B | 744/755/747 | 0.69/0.71/2.93 | 0.97/4.13 | |
| | | | avg. | 1.48 ± 0.35 |

I claim:

1. An improved composite cobulked continuous filament yarn containing a first oriented continuous multifilament yarn which has been bulked in a hot fluid jet process simultaneously with a second oriented continuous multifilament yarn, the filaments of both yarns being randomly intermingled throughout the length of the composite yarn and having random three-dimensional curvilinear filament crimp with frequently alternating regions of S and Z filament twist, the filaments of said second yarn being from about 4% to about 20% longer in said composite yarn than the filaments of said first yarn, wherein the improvement comprises: the filaments of said first and second yarns being of polymers containing the same type of chemical dye site with the filaments of said second yarn having a substantially greater concentration of said dye site in equivalents per unit weight of polymer than the filaments of said first yarn, thus providing differential dyeability, and the filaments of said first yarn and of said second yarn each comprise from about 25% to about 75% of the total denier of said composite yarn.

2. A yarn of claim 1 wherein the filaments of said second yarn are from 4 to 10% longer than, and have enhanced dyeability with respect to, the filaments of said first yarn.

3. A yarn of claim 2 wherein the polymers of said first and second yarns are polyamides and said chemical dye sites are polyamide amine end groups.

4. A yarn of claim 3 wherein said first yarn is a cationically dyeable polyamide yarn.

5. A yarn of claim 4 wherein the polymer of said first yarn contains at least about 50 equivalents per $10^6$ grams of cationically dyeable sulfonate dye sites and the polymer of said second yarn contains at least about 50 equivalents per $10^6$ grams of amine end groups.

6. A yarn of claim 5 in which the ratio of dye concentration in filaments of said second yarn to filaments of said first yarn when dyed competitively with C.I. Acid Blue 40 as described herein is greater than 5.0.

7. A yarn of claim 3 or 5 wherein the differential acid dyeability between the first and second yarns is enhanced by at least 1.5X compared to a comparable composite yarn prepared by comingling separately bulked comparable yarns in an ambient air jet.

8. A yarn of claim 2 wherein any remaining filaments in the composite yarn consist essentially of a prebulked third continuous filament yarn which is differentially dyeable with respect to both of said first and second yarns.

9. A yarn of claim 8 wherein said first, second and third yarns each comprise about ⅓ of the total composite yarn denier.

10. A yarn of claim 2 consisting essentially of filaments of said first and of said second yarns with each of said yarns comprising about 50% of the total composite yarn denier.

11. A yarn of claim 2, 3, 5 or 10 wherein the filaments of said first yarn have a substantially lower crimp frequency and a substantially greater tenacity and toughness than filaments of said second yarn.

12. A yarn of claim 5, 6 or 10 wherein the second yarn has been prebulked in a hot fluid jet process prior to said simultaneous bulking with said first yarn.

13. In a method of producing a composite cobulked continuous filament yarn containing filaments of a first oriented continuous filament yarn and of a second oriented continuous filament yarn in which the filaments of said second yarn are longer than the filaments of said first yarn said method including the steps of (1) feeding said first yarn in an undrawn state at a controlled speed to a pair of heated draw rolls, (2) wrapping said first yarn around said draw rolls a sufficient number of times to avoid slippage thereon and said rolls being driven at surface speed at least twice the feeding speed of said first yarn thereby applying tension to and drawing to molecularly orient said first yarn, (3) also feeding to said pair of draw rolls from a yarn package at a tension of less than 1.0 grams per denier said second yarn having a lower shrinkage potential in a hot gas bulking jet than said first yarn, (4) wrapping said second yarn around said draw rolls to prevent slippage thereon, (5) bringing said first and second yarns together and forwarding the combined yarns in a high velocity stream of hot turbulent fluid in a confined space which randomly crimps and entangles the filaments thereof and thereby forms a composite cobulked yarn in which the filaments of said second yarn are from about 4% to about 20% longer than the filaments of said first yarn, (6) removing the cobulked yarn from the stream of hot fluid and cooling it at low tension while the filaments are in a crimped condition to set crimp in the filaments and (7) winding the cobulked yarn into a package under tension, the improvement for making a heather dyeable yarn comprising: feeding to said draw rolls as said second yarn a heat-relaxed yarn containing crimped filaments which filaments are differentially dyeable with respect to the filaments of said first yarn and which filaments constitute from about 25% to about 75% of the total denier of the cobulked yarn.

14. The method of claim 13 wherein the feeding tension on said second yarn is less than about 0.8 grams per denier and the differential change in length between said first yarn and second yarn in the cobulking step is such that in the cobulked yarn the filaments of said second yarn are from 4% to 10% longer than the filaments of said first yarn.

15. The method of claim 14 wherein the second yarn has been heat-relaxed and crimped in a hot fluid jet-bulking process.

16. The method of claim 14 including feeding to the draw rolls at a tension of less than 0.8 grams per denier as a third yarn one which has been previously hot-fluid-jet-bulked and which is differentially dyeable with respect to both of said first and second yarns and which constitutes at least about 25% of the denier of the cobulked yarn.

17. The method of claim 14 wherein the cobulked yarn consists essentially of said first and second yarns with each yarn constituting at least about ⅓ of the denier of the cobulked yarn.

18. The method of claim 17 wherein said first and second yarns each constitute about 50% of the denier of the cobulked yarn.

19. The method of claim 18 wherein the draw rolls are driven at a surface speed of at least 1,000 meters/minute.

20. The method of claim 19 wherein said first yarn is fed to the draw rolls directly from a zone in which the undrawn filaments are formed by melt-spinning.

21. The method of claim 20 wherein the filaments of said first and second yarns are comprised of 66-nylon or 6-nylon.

22. The method of claim 21 wherein the polymer of said first yarn contains cationically dyeable sulfonate dye sites and the polymer of said second yarn is acid-dyeable and contains greater than 50 equivalents of polymer amine end groups per $10^6$ grams of polymer.

23. The method of claim 13 or 22 wherein the differential dyeability is enhanced at least 1.5X with respect to filaments of the same compositions individually bulked under substantially the same bulking conditions but without any rebulking of the second yarn.

* * * * *